US006454223B1

(12) United States Patent
Rosky

(10) Patent No.: US 6,454,223 B1
(45) Date of Patent: Sep. 24, 2002

(54) SUPPORT FRAME FOR PLASTIC BAG WITH HANDLES

(75) Inventor: Gregory C. Rosky, Des Moines, IA (US)

(73) Assignee: Underground Company, L.T.D., Des Moines, IA (US)

( * ) Notice: Subject to any disclaimer, the term of this patent is extended or adjusted under 35 U.S.C. 154(b) by 0 days.

(21) Appl. No.: 09/647,440

(22) PCT Filed: Mar. 29, 1999

(86) PCT No.: PCT/US99/06757

§ 371 (c)(1),
(2), (4) Date: Sep. 28, 2000

(87) PCT Pub. No.: WO99/49941

PCT Pub. Date: Oct. 7, 1991

(51) Int. Cl.[7] ..... B65B 67/04
(52) U.S. Cl. ..... 248/100; 248/175
(58) Field of Search ..... 248/99, 100, 101, 248/95, 175, 165, 188.91

(56) References Cited

U.S. PATENT DOCUMENTS 4,921,193 A * 5/1990 Benesch ..... 248/67
5,263,672 A * 11/1993 He ..... 248/97
5,799,908 A * 9/1998 Downs ..... 248/97

* cited by examiner

*Primary Examiner*—Ramon O. Ramirez

(57) ABSTRACT

A support frame (10) for a plastic bag (26) with opposite handles (12) has a horizontal rectangular base member (25) in the form of a tray with four upstanding struts (12A) extending from sockets (24) in the comers of the tray (25). Horizontal braces (20) are frictionally secured between two each of the struts (12A). The upper end of the struts (12A) terminate in U-shaped hooks (18) that extend inwardly in a direction towards the space over the base member (25) to permit a bag (26) with separate upper handles (28) and a body portion to have one each of its handles (28) supported on opposite pairs of the hooks (18) with the body portion suspended therebetween.

7 Claims, 6 Drawing Sheets

SUPPORT FRAME FOR PLASTIC BAG WITH HANDLES

BACKGROUND OF THE INVENTION

Plastic bags with handles are fast replacing conventional paper bags for carrying groceries and other goods from supermarkets and other retail stores. The plastic bags have further use in homes after their primary use is finished in that the bags have further utility as containers for trash. However, it is cumbersome at best to place trash in the bags because they are not self-standing and the opening at the tops thereof often closes upon itself as the flexible bag collapses. It is most inconvenient to hold the bag open with one hand, and insert or deposit trash in the bag with the other hand.

It is therefore a principal object of this invention to provide a support frame for such bags which will hold the bag in an open upstanding condition for easy filling.

A further object of the invention is to provide a support frame for such bags that is lightweight, inexpensive to construct, and refined in appearance. These and other objects will be apparent to those skilled in the art.

SUMMARY OF THE INVENTION

A support frame for a plastic bag with opposite handles has a horizontal rectangular base member in the form of a tray with four upstanding struts extending from sockets in the corners of the tray. Horizontal braces are frictionally secured between two each of the struts. The upper end of the struts terminate in U-shaped hooks that extend inwardly in a direction towards the space over the base member to permit a bag with separate upper handles and a body portion to have one each of its handles supported on opposite pairs of the hooks with the body portion suspended therebetween.

DESCRIPTION OF THE PREFERRED EMBODIMENT

Figure 1:
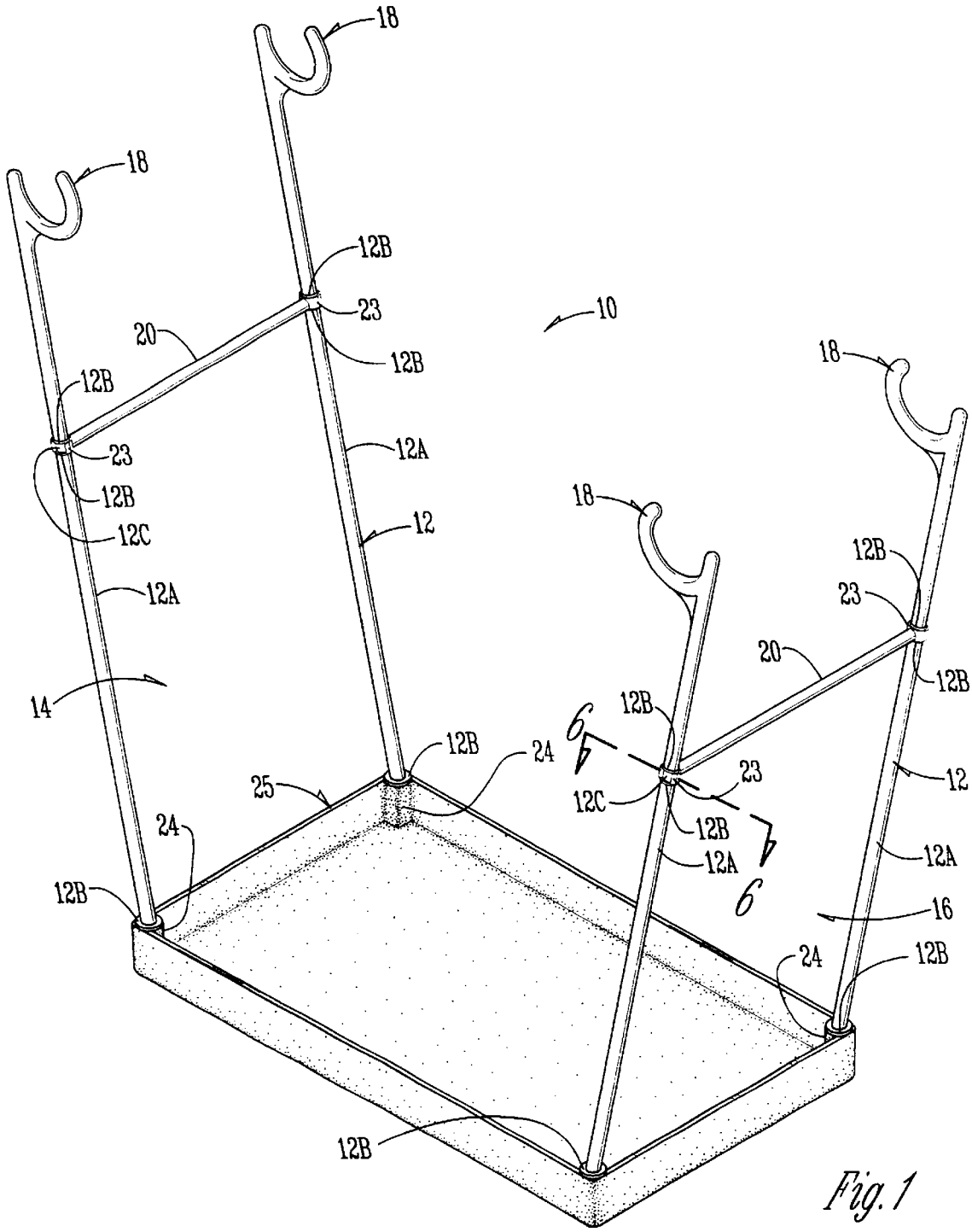
FIG. 1 is a perspective view of the support frame.

The support frame 10 (FIG. 1) has duplicate spaced opposite sides 12 which have upwardly and outwardly extending end portions 14 and 16 terminating in hooks 18. The U-shaped hooks are open at the top and extend inwardly in a direction towards the space between the end portions to permit a bag with separate upper handles and a body portion to have one each of its handles supported on opposite pairs of the hooks with the body portion suspended therebetween.

Figure 6:
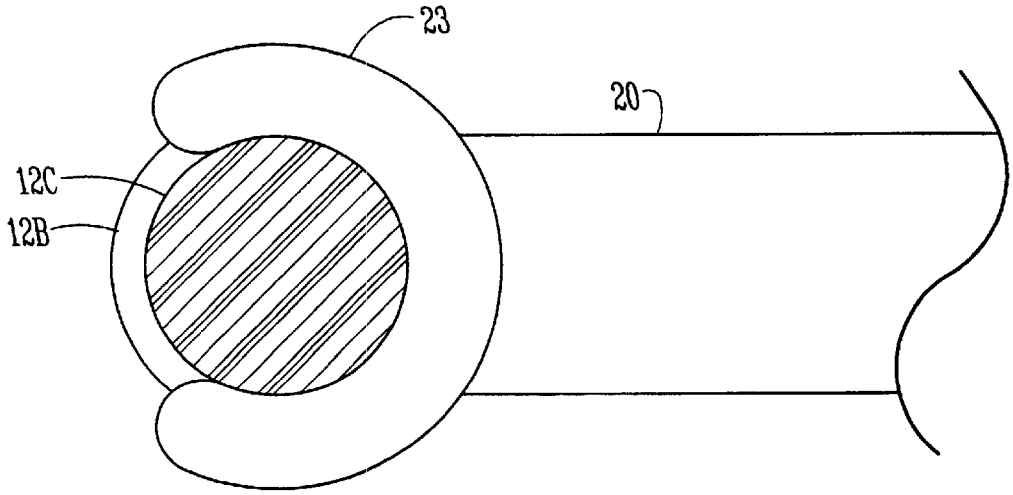
FIG. 6 is an enlarged scale sectional view taken on line 6—6 of FIG. 1.
Figure 7:
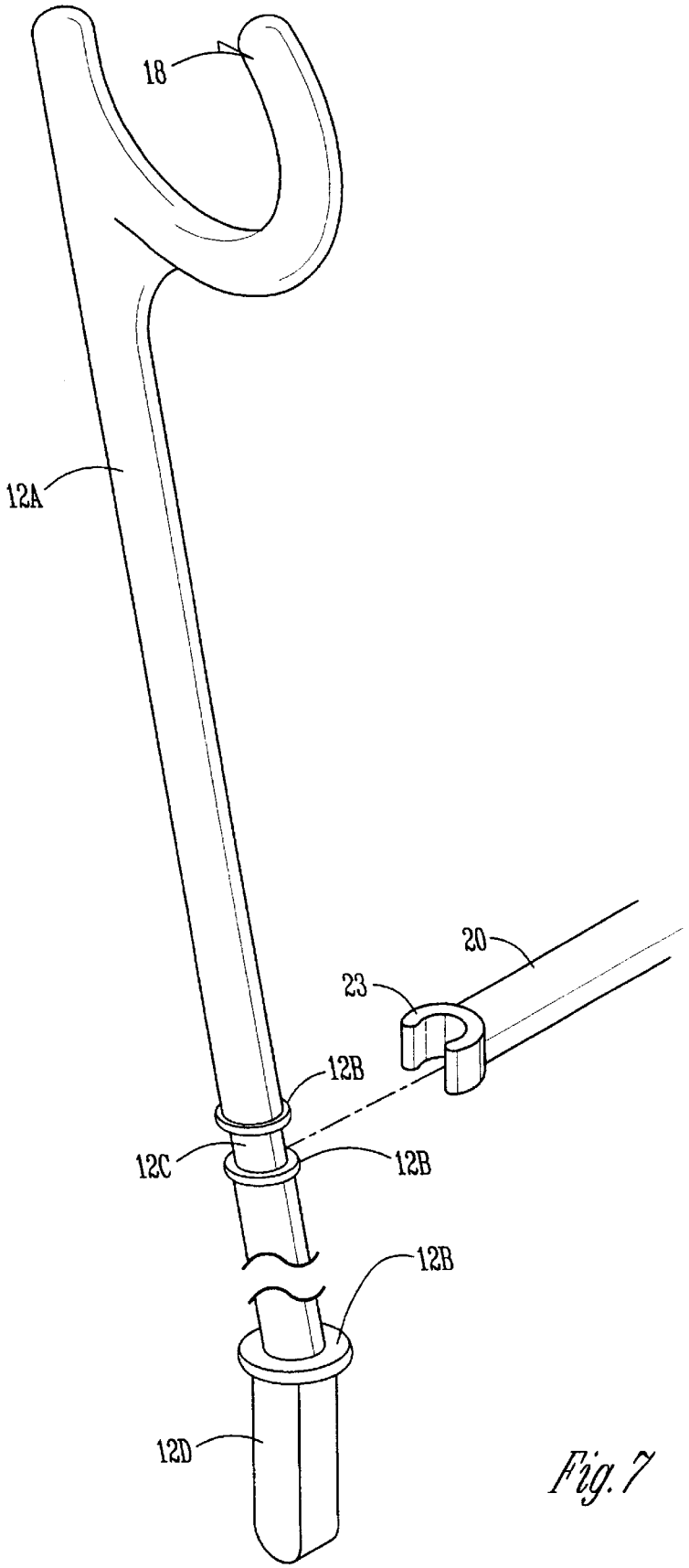
FIG. 7 is an exploded partial perspective view of a strut that receives a cross brace.

Braces 20 and 22 secure sides 12 together. Frame 10 is comprised of stiff but resilient plastic material (struts 12A, and braces 20 and 22). The ends of the braces 20 and 22 have U-shaped snap connectors 23 to detachably but frictionally engage struts 12 A (FIG. 6). The snap connections 23 are nested between annular rings 12B in area 12C (FIG. 7).

The lower square ends 12D of struts 12A are detachably frictionally inserted into the sockets 24 of the four sided tray 25. An annular ring 12A is also located above the end 12D.

It should also be noted that the square lower ends 12D of the struts 12A are normally received in a vertical configuration within the sockets 24. The strut however is then bent slightly outwardly from the square ends 12D as clearly shown in FIGS. 1 and 7.

Figure 2:
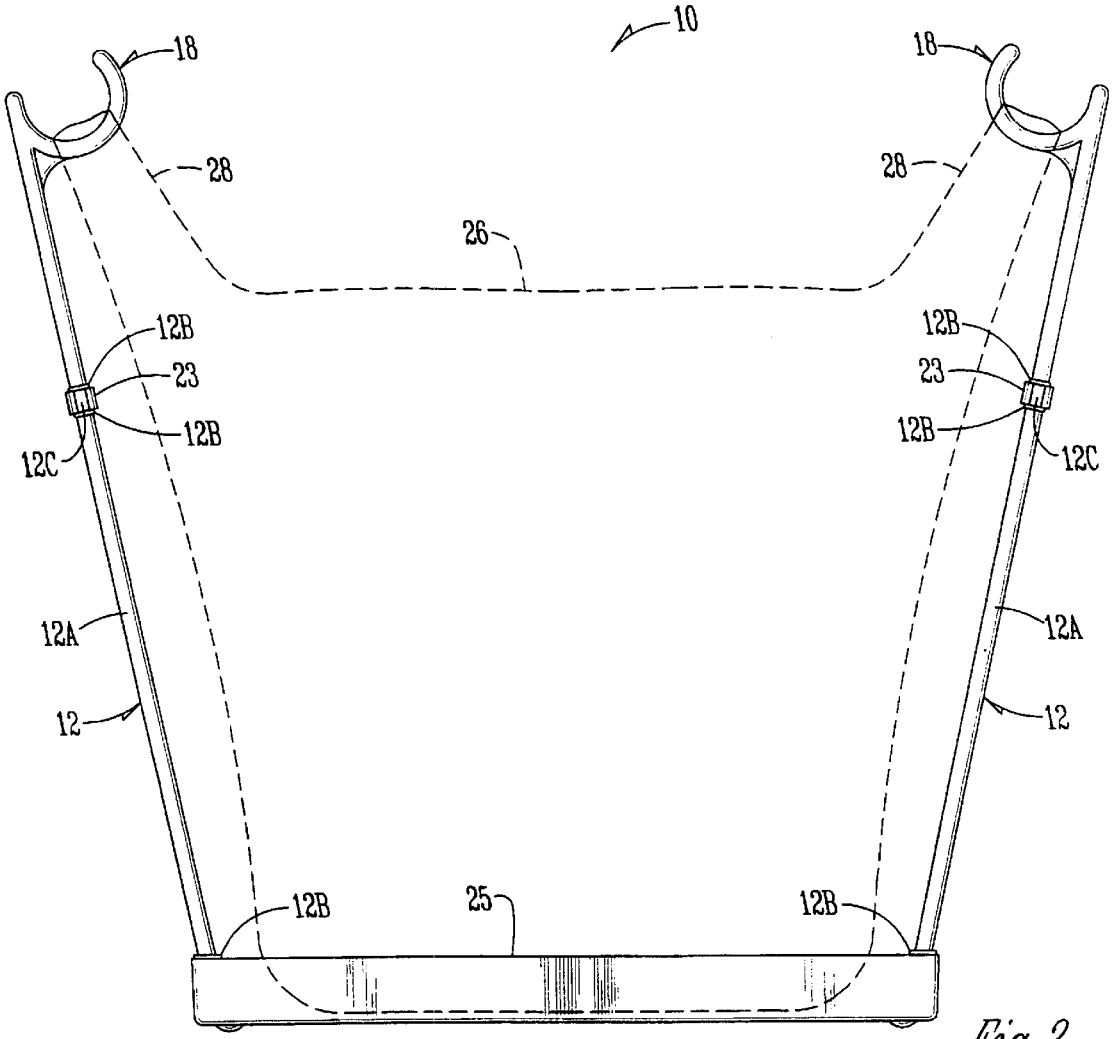
FIG. 2 is a side elevational view of the support frame with a plastic bag shown in dotted lines supported by the frame.
Figure 3:
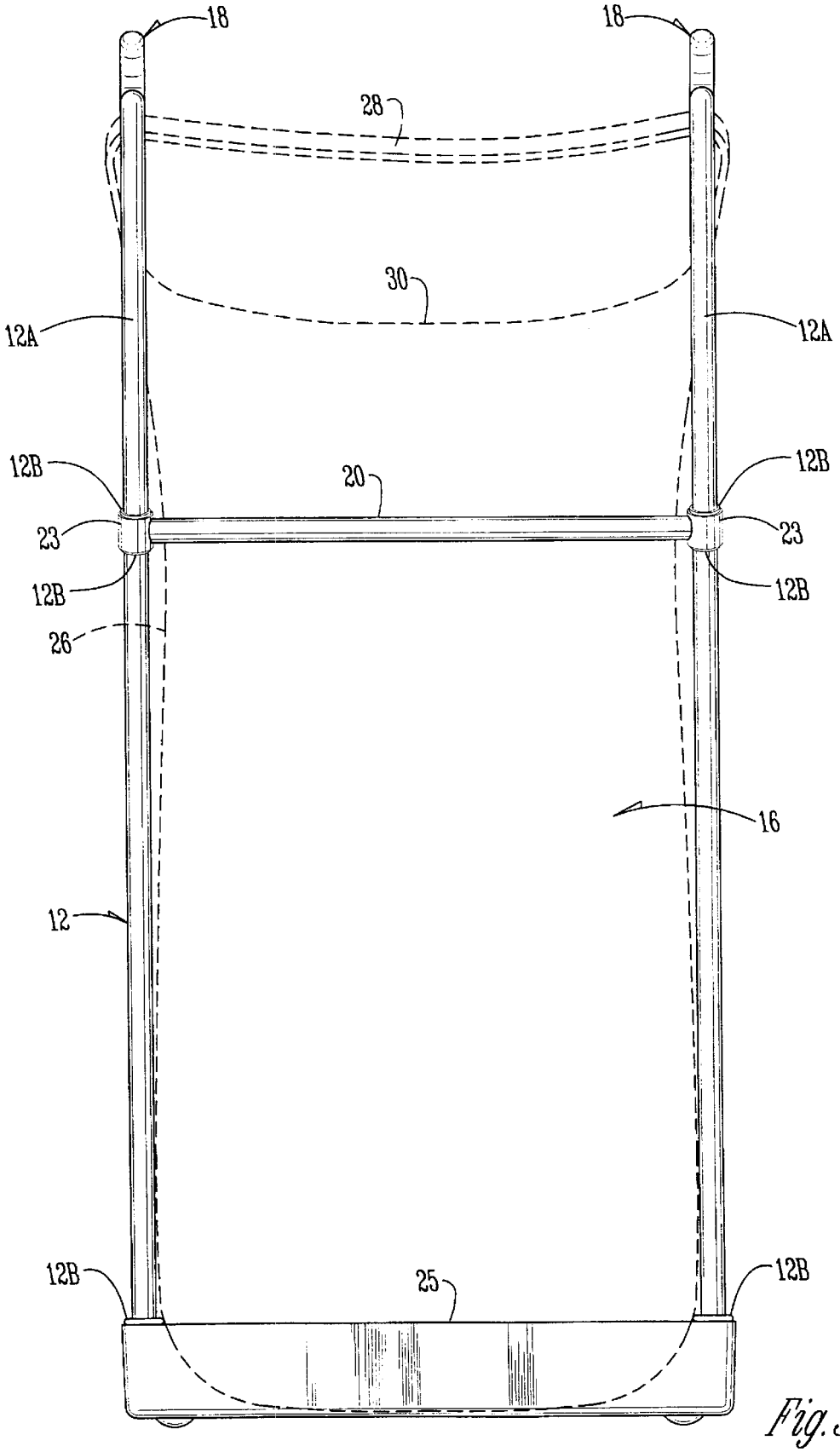
FIG. 3 is an end elevational view thereof.
Figure 4:
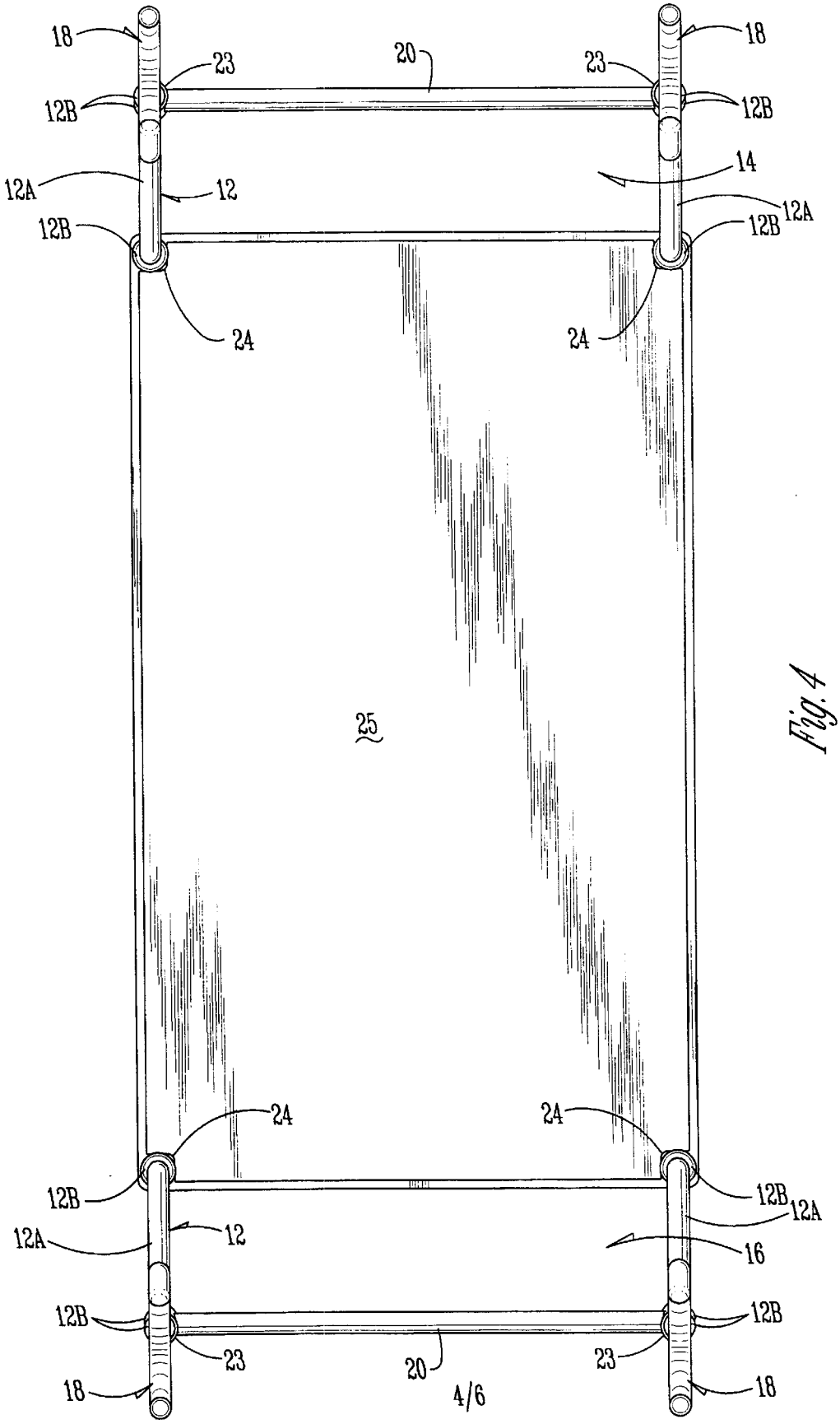
FIG. 4 is a top plan view thereof.
Figure 5:
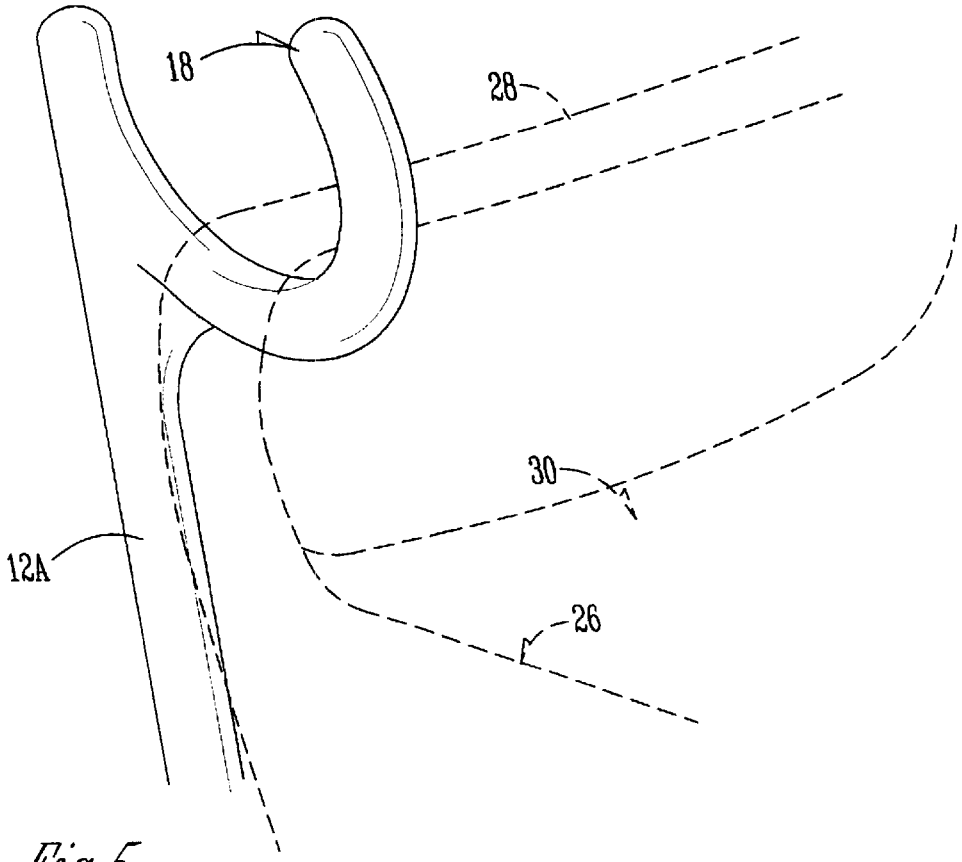
FIG. 5 is an enlarged scale perspective view of a hook on the frame for supporting the bag.

A bag 26 has opposite loop handles 28. The handles are draped over the hooks 18 as shown by the dotted lines in FIGS. 2 and 5. The top opening 30 of the bag is thereby held in an open condition (FIG. 3).

It should be noted that the length of the struts 12A is such that when the bag 26 is suspended on hooks 18, the bottom of the bags 26 can rest on the bottom of the tray 25.

For shipping and packaging purposes, the struts 12A are removed from the sockets 24, and the braces 20 and 22 are detachably removed from the struts by means of the U-shaped snap connectors 23. The support frame 10 is thereupon easily assembled by inserting the struts 12A into the sockets 24, and then placing the braces 20 and 22 in connection with the struts 12A as described above through the use of the U-shaped snap connectors 23. The frame in operation is therefore very sturdy, but the frame 10 does has some slight resiliency to slightly flex depending upon the degree to which the bag 26 is filled with trash or the like. When the bag is full, it is easily removed from the hooks 18, and replaced with another disposable bag.

It is therefore seen that this invention will achieve at least all of its stated objectives.

What is claimed is:

1. A support frame for a plastic bag with opposite handles, comprising, a horizontal rectangular base member, wherein the base member is tray having four comers with a socket in each comer, with four upstanding struts extending upwardly from the base member, horizontal braces extending between two each of the struts, the upper end of the struts terminating in U-shaped hooks that extend inwardly in a direction towards the space over the base member and the lower ends of the struts being detachably frictionally secured in sockets on the base member, the struts being of such a length that a bottom of bag can rest in the tray when suspended on the hooks, the hooks permitting the bag with separate upper handles and a body portion to have one each of handles supported on opposite pairs of the hooks with the body portion suspended therebetween.

2. The support frame of claim 1 wherein the struts are circular in cross section except for the lower ends which are square in the cross section.

3. The support frame of claim 2 wherein a stop element is located on each strut above the square lower ends.

4. The support frame of claim 3 wherein the stop element is an annular ring.

5. The support frame of claim 1 wherein the braces are detachably and frictionally snapped into engagement by U-shaped connectors on the ends of the braces.

6. The support frame of claim 5 wherein spaced stop elements are on the struts above and below the U-shaped connectors on the ends of the braces.

7. The support frame of claim 6 wherein the stop elements are annular rings.

* * * * *